US007219852B2

(12) United States Patent
Tramontina et al.

(10) Patent No.: US 7,219,852 B2
(45) Date of Patent: May 22, 2007

(54) DISPENSER FOR MULTIPLE ROLLS OF SHEET MATERIAL

(75) Inventors: Paul Francis Tramontina, Alpharetta, GA (US); Richard Paul Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 306 days.

(21) Appl. No.: 10/920,756

(22) Filed: Aug. 18, 2004

(65) Prior Publication Data

US 2006/0038054 A1 Feb. 23, 2006

(51) Int. Cl.
*B65H 23/06* (2006.01)

(52) U.S. Cl. ..... 242/422.5; 242/560; 242/594.5

(58) Field of Classification Search ..... 242/422.5, 242/560, 560.2, 561, 594, 594.5, 597, 597.4, 242/597.8

See application file for complete search history.

(56) References Cited

U.S. PATENT DOCUMENTS

| | | | | |
|---|---|---|---|---|
| 2,805,030 | A | 9/1957 | Wolters | |
| 3,211,504 | A | 10/1965 | Bump | |
| D307,845 | S | 5/1990 | Omdoll et al. | |
| D335,410 | S | 5/1993 | Abel et al. | |
| 5,265,816 | A | 11/1993 | Collins | |
| D373,276 | S | 9/1996 | Omdoll et al. | |
| 5,645,244 | A * | 7/1997 | Moody | 242/422.5 |
| D384,531 | S | 10/1997 | Mervar et al. | |
| 5,813,624 | A | 9/1998 | Grasso et al. | |
| 5,833,169 | A | 11/1998 | Morand | |
| 5,868,342 | A | 2/1999 | Moody et al. | |
| 6,036,134 | A | 3/2000 | Moody | |
| 6,161,794 | A * | 12/2000 | Cravatt | 242/560.3 |
| 6,202,956 | B1 | 3/2001 | Grasso et al. | |
| 6,364,245 | B1 * | 4/2002 | Paal et al. | 242/560 |

FOREIGN PATENT DOCUMENTS

| | | | |
|---|---|---|---|
| CA | 2359128 | A1 | 4/2003 |
| FR | 2627071 | A | 8/1989 |

* cited by examiner

*Primary Examiner*—Patrick Mackey
*Assistant Examiner*—William E. Dondero
(74) *Attorney, Agent, or Firm*—Richard M. Shane; Nathan P. Hendon

(57) ABSTRACT

In one embodiment, a dispenser for dispensing rolls of sheet material is provided. The dispenser includes a housing configured to rotationally support a primary roll of sheet material and a backup roll of sheet material inside the housing. The housing also includes an exit port. The dispenser further includes a dispensing control member moveably positioned substantially within and partially blocking the exit port. The dispensing control member is configured to substantially restrict rotation of the backup roll of sheet material prior to substantial depletion of the primary roll of sheet material.

17 Claims, 4 Drawing Sheets

DISPENSER FOR MULTIPLE ROLLS OF SHEET MATERIAL

BACKGROUND

Dispensers for bath tissue used in institutional and public restrooms are often configured to provide a "jumbo" roll of sheet material or bath tissue therein. For increased capacity and to extend the time between restocking, some of these dispensers are configured to accommodate a second, or backup, jumbo roll, which is disposed alongside the primary jumbo roll. It would be advantageous to have a dispenser that would accommodate a backup jumbo roll, yet restrict a user from dispensing sheet material from the backup roll prior to substantial depletion of the primary roll.

DEFINITIONS

As used herein, the term "exit port" or "dispensing opening" is the opening in a housing of a dispenser for the passage of sheet material out of the dispenser.

As used herein, the term "fasteners" means devices that fasten, join, connect, secure, hold, or clamp components together. Fasteners include, but are not limited to, screws, nuts and bolts, rivets, tape, snap-fits, tacks, nails, loop fasteners, and interlocking male/female connectors, such as fishhook connectors. A fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, spring-loaded hinges, living hinges, and so forth. Living hinges may be constructed from plastic and other materials and formed integrally between two members. A living hinge permits movement, such as, but not by way of limitation, pivotable movement, of one member in relation to another connected member.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, bath/toilet tissue, paper towels, wipes, label rolls, or other fibrous, film, or filamentary products.

SUMMARY OF THE INVENTION

In one embodiment, a dispenser for storing and dispensing rolled sheet material includes a housing configured to rotationally support a primary roll of sheet material and a backup roll of sheet material inside the housing. The housing also includes an exit port. The dispenser further includes a dispensing control member moveably positioned substantially within and partially blocking the exit port. The dispensing control member is configured to substantially restrict rotation of the backup roll of sheet material prior to substantial depletion of the primary roll of sheet material. In another embodiment, the dispensing control member includes at least one projection positioned on an inside surface of the dispensing control member. The projection substantially restricts rotation of the backup roll of sheet material.

In a further embodiment, a dispenser for storing and dispensing rolled sheet material includes a housing having an interior and configured to rotationally support a primary roll of sheet material and a backup roll of sheet material therein. The housing is formed to include an exit port positioned to allow insertion of the primary roll of sheet material and the backup roll of sheet material into the housing interior. The dispenser further includes a dispensing control member moveably positioned substantially within and partially blocking the exit port. The dispensing control member includes a divider extending into the housing interior between the primary roll of sheet material and the backup roll of sheet material to a distance sufficient to substantially restrict movement of the dispensing control member prior to substantial depletion of the primary roll of sheet material. The dispensing control member further includes a plurality of ribs positioned on an inside surface of the dispensing control member. The ribs are positioned to substantially restrict rotation of the backup roll of sheet material prior to substantial depletion of the primary roll of sheet material.

In an even further embodiment, a dispenser for storing and dispensing rolled sheet material includes a housing configured to rotationally support a primary roll of sheet material and a backup roll of sheet material therein. The dispenser further includes a means for substantially restricting rotation of the backup roll of sheet material prior to substantial depletion of the primary roll of sheet material.

DETAILED DESCRIPTION

Figure 1:
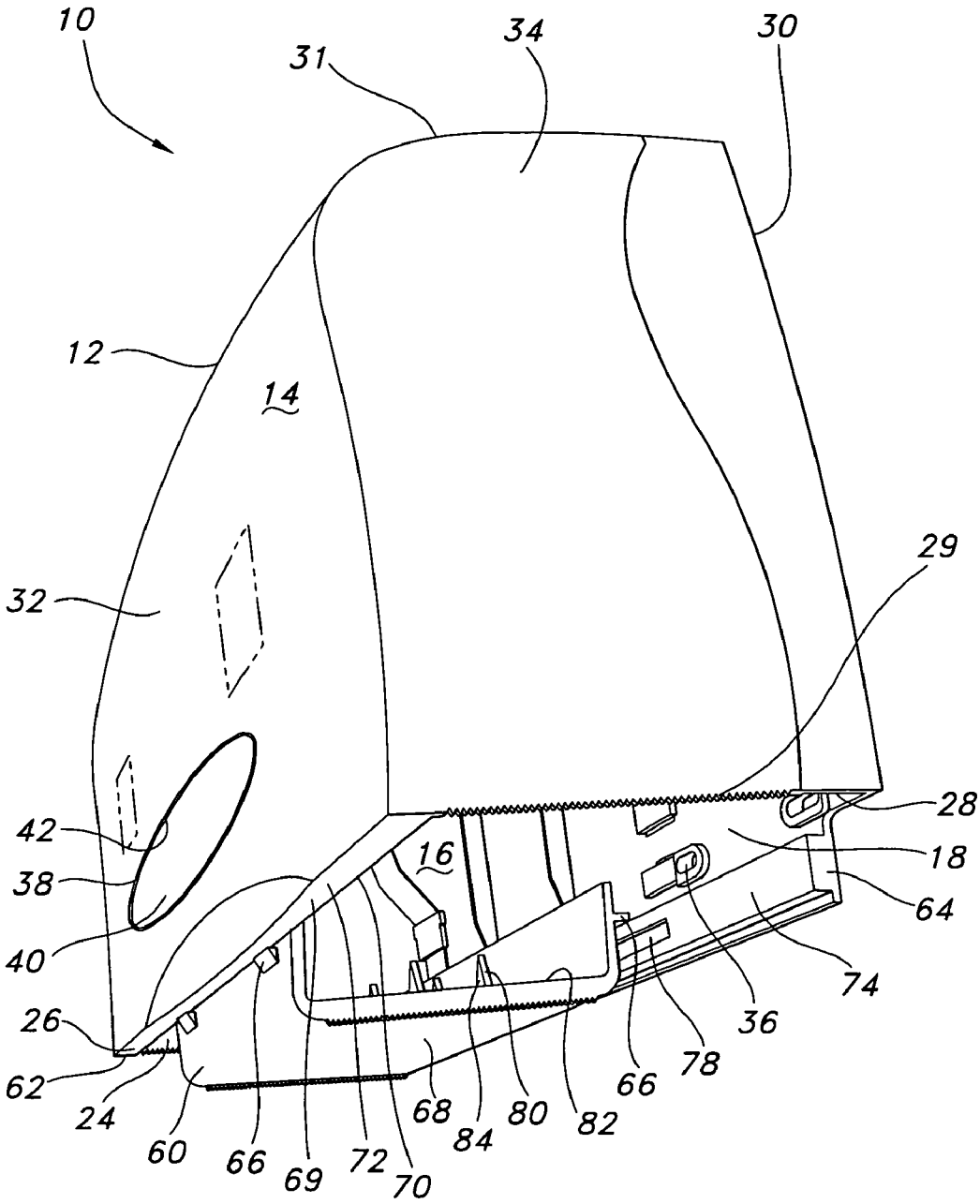
FIG. 1 is a perspective view of an embodiment of a dispenser.

Reference will now be made in detail to the embodiments of the invention, one or more examples of which are set forth below and illustrated in the drawings. Each example is provided by way of explanation of the invention and is not meant as a limitation of the invention. For example, features illustrated and described as part of one embodiment or figure can be used on another embodiment or figure to yield yet another embodiment. It is intended that the present invention include such modifications and variations.

Figure 3:
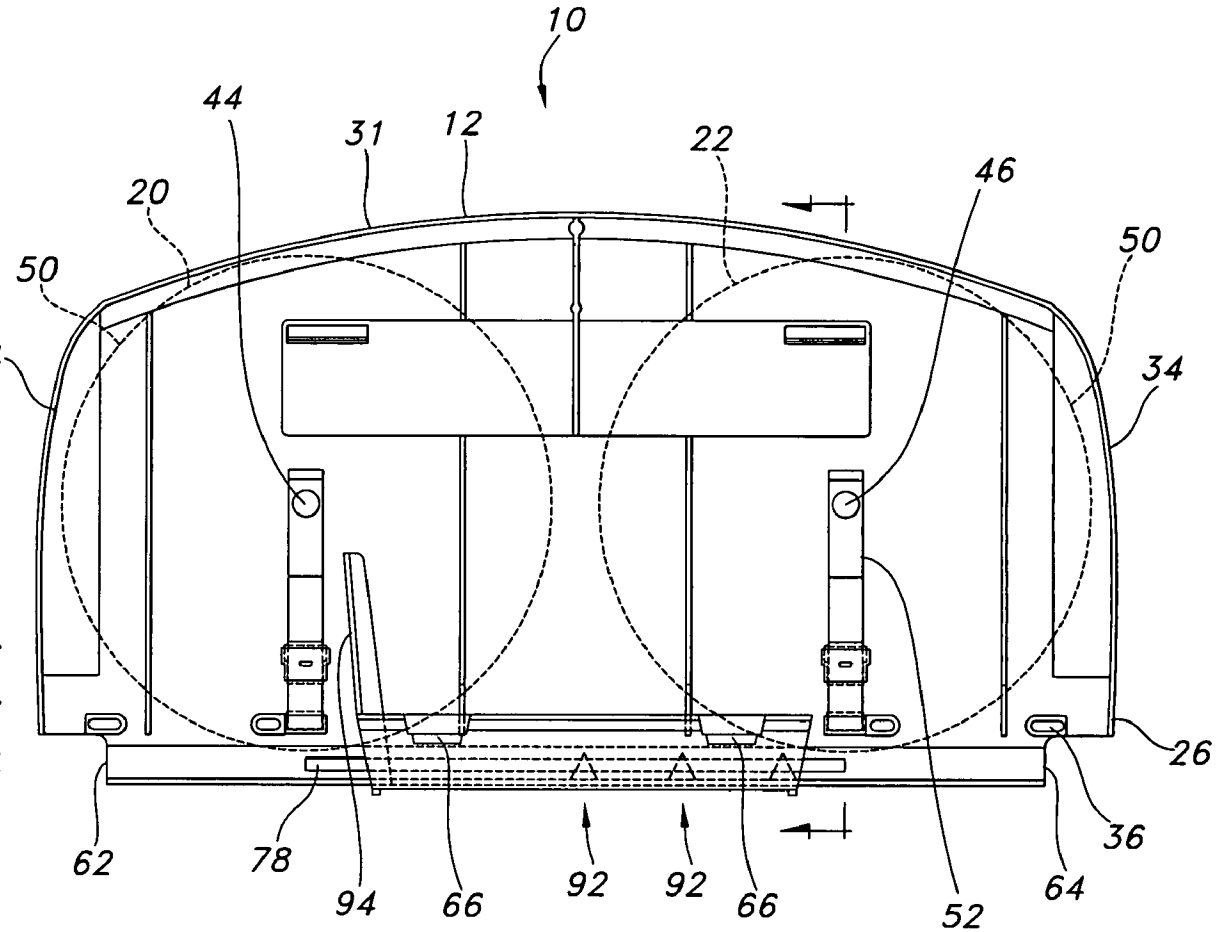
FIG. 3 is a cross-sectional front view of the dispenser of FIG. 1.
Figure 2:
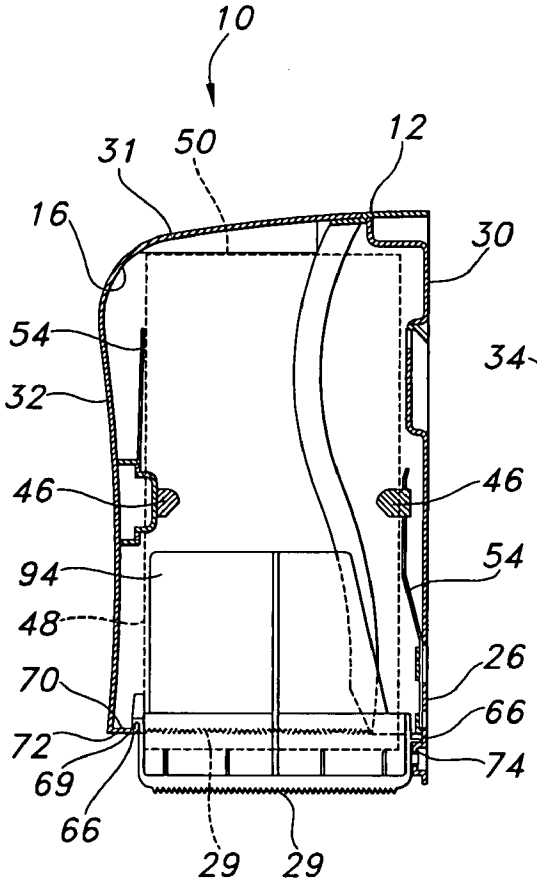
FIG. 2 is a cross-sectional end view of the dispenser of FIG. 1.
Figure 4:
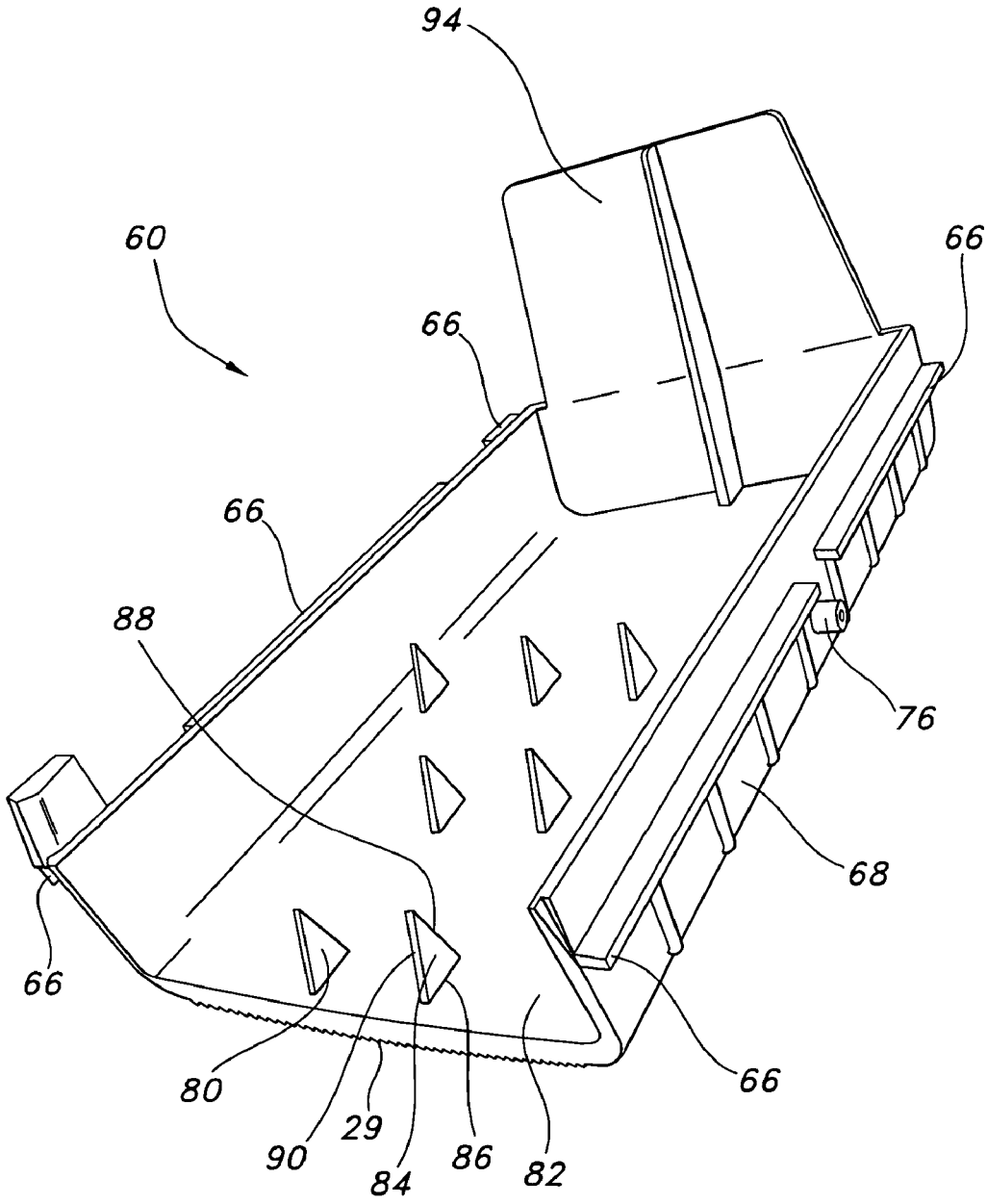
FIG. 4 is a perspective view of an embodiment of a dispensing control member.

As illustrated in FIGS. 1–3, the dispenser 10 includes a housing 12 having an exterior surface 14 and an interior surface 16. The housing 12 defines an internal compartment 18 within which the housing is capable of rotationally supporting a first, or primary, roll of paper 20 and a second, or backup roll of paper 22. The housing 12 further defines a dispensing opening or exit port 24 which provides a user access to the sheet material on the paper rolls. Desirably, the exit port 24 is substantially rectangular in shape, and permits loading of the paper rolls through the exit port. In the present embodiment, but not by way of limitation, the exit port 24 is provided in a lower portion 26 of the housing 12. Desirably, a perimeter 28 of the exit port 24 includes at least one serrated portion 29 to permit sections of sheet material to be severed and removed from one or more rolls of sheet material disposed in the internal compartment 18 of the housing 12.

The housing 12 generally includes a top wall 31 contiguous with a back wall 30, an opposing front wall 32, and a pair of spaced-apart opposing side walls 34. The back wall 30 is configured to be mounted on a surface or wall, such as, by way of non-limiting example, the wall of a toilet stall (not shown). The back wall 30 defines a plurality of openings 36 to permit such mounting via fasteners, brackets, hinges, adhesives, and so forth.

The front wall 32 defines a window opening 38 provided therein. A window plate 40 is mounted on an inner surface 42 of the front wall 32 over the window opening 38. The window plate 40 may be, for example, but not by way of limitation, clear, transparent, tinted, and so forth, to provide a view of the size and amount of the remaining rolls of sheet material in the dispenser 10 to a user or a maintenance technician. It will be appreciated, however, that any portion (s) of the housing 12 may be clear, transparent, tinted, opaque, and so forth.

It will be appreciated that in the present embodiment, the configuration of the housing 12 is not intended as a limitation; other configurations may be used to accommodate aesthetic and/or functional considerations.

As described above, the dispenser 10 and housing 12 are desirably configured to hold at least two rolls of sheet material, for example, the primary roll of sheet material 20 and the backup roll of sheet material 22. Such sheet material is often flexible, such as toilet or bath tissue and so forth. Each roll 20, 22 may be wound throughout its diameter about a longitudinal open core or may be coreless, and each roll forms, generally, a cylinder having opposing flat ends 48 and an outer circumferential surface 50. The sheet material forming the rolls 20, 22 is desirably non-perforated sheet material, although sheet material perforated into sheet sections of predetermined length may also be used.

A first pair of mandrels/hubs 44 and a second pair of mandrels/hubs 46 are mounted on the housing 12, each pair including a mandrel/hub on the front wall 32 and the back wall 30. The first pair of hubs 44 holds the primary roll of sheet material 20 and the second pair of hubs 46 holds the backup roll of sheet material 22. The rolls 20, 22 are positioned on the hubs 44, 46 such that the center 52 of each roll 20, 22 is mounted on a hub 44, 46 and each roll 20, 22 is mounted with its outer circumferential surface 50 adjacent the other. One flat end 48 of each roll 20, 22 is positioned adjacent the back wall 30 while the opposite flat end 48 of each roll 20, 22 is positioned adjacent the front wall 32. The pairs of mandrels/hubs 44, 46 are configured to rotationally support the rolls of sheet material 20, 22. The mandrels/hubs 44, 46 may be fixed or may rotate along with the rolls of sheet material 20, 22. Support arms 54, desirably cantilevered support arms, may be attached to the interior surface 16 of the housing 12 to provide further support to the rolls of sheet material 20, 22. In one embodiment, the mandrels/hubs 44, 46 may be cantilevered on an end of the support arm 54. The support arms 54 are configured to apply pressure against and support the flat ends 48 of the rolls of sheet material 20, 22.

Desirably, the dispenser 10 of the present embodiment is generally designed to hold a pair of large, or jumbo, rolls. A jumbo roll is generally, but not by way of limitation, considered to have a diameter greater than about 8 inches. It will be appreciated that the dispenser 10 and the housing 12 may be sized to include additional hubs to hold additional rolls of larger or smaller roll sizes as well as combinations of roll sizes.

Referring now to FIGS. 1–4, the dispenser 10 further includes a dispensing control member 60. The dispensing control member 60 is moveably attached to the housing 12. The dispensing control member 60 is desirably positioned within or near the exit port 24, and partially blocks the exit port. Desirably, the dispensing control member 60 includes at least one serrated portion 29 to permit sections of sheet material to be severed and removed from one or more rolls of sheet material disposed in the internal compartment 18 of the housing 12. The dispensing control member 60 is capable of moving in a primary direction of travel between a first end 62 of the exit port 24 (at which position the dispensing control member leaves exposed the second (or backup) roll of sheet material 22) to a second end 64 of the exit port (at which position the dispensing control member leaves exposed the first (or primary) roll of sheet material 20). In one embodiment, the dispensing control member 60 is partially supported upon the housing 12 by tabs 66 on an outside surface 68 of the dispensing control member. As one example, the tabs 66 may be arranged adjacent first and second sides 69, 70 of a lip 72 formed in the perimeter 28 of the exit port 24. As another example, the tabs 66 may slidingly rest on a ridge 74 formed on the interior surface 16 on or near the lower portion 26 of the housing 12. To slidingly restrain the dispensing control member 60, a projection 76 on the dispensing control member may be slidingly restrained within a slot 78 in the housing 12 by a fastener (not shown). The slot 78 may include one or more slight restrictions (not shown) to partially restrict movement of the retaining fastener within the slot. Additional force is required to move the fastener past the restriction. For example, restrictions in the slot 78 near the ends of the slot may be used to in effect lock the dispensing control member 60 into position at either end of the exit port 24.

The dispensing control member 60 is desirably configured to substantially restrict rotation of the backup roll of sheet material 22 prior to substantial depletion of the primary roll of sheet material 20 when the dispensing control member 60 is positioned towards the second end 64 of the exit port 24. As such, the dispensing control member 60 desirably includes a means for substantially restricting rotation of the backup roll 22 prior to substantial depletion of the primary roll 20. In one embodiment, the dispensing control member 60 includes at least one projection 80 positioned on an inside surface 82 of the dispensing control member. In another embodiment, the inside surface 82 may contact the backup roll 22 when the dispensing control member 60 is positioned towards the second end 64 of the exit port 24 and thus substantially restrict rotation of the backup roll. In a further embodiment, the inside surface 82 may be roughened to increase friction against the outer circumferential surface 50 of the backup roll 22 to substantially restrict rotation of the backup roll. By "substantially restrict rotation", it is meant that the backup roll 22 will be restrained such that force applied to the tail of sheet material extending from the backup roll will cause the sheet material to break rather than causing the roll to rotate and dispense additional sheet material. In other embodiments, the dispensing control member may more fully restrict or prevent rotation of the backup roll 22.

Desirably, the projection 80 includes a triangular rib 84. More desirably, an edge 86 of the triangular rib 84 may be attached to the inside surface 82 of the dispensing control member 60 wherein the attached edge 86 is oriented parallel to the primary direction of travel of the dispensing control member. Even more desirably, the attached edge 86 is shorter than a first unattached edge 88 and a second unattached edge 90 of the triangular rib 84 extending from the inside surface 82 of the dispensing control member 60.

Desirably, the dispensing control member 60 will include a plurality of projections 80 positioned on the inside surface 82 of the dispensing control member 60. More desirably, the plurality of projections 80 are arranged in rows 92 with each row having at least two projections. In some embodiments, the rows 92 may have two, three, four, or more projections. When there is more than one row 92, the rows may have equal or unequal numbers of projections 80. The rows 92 are desirably positioned substantially perpendicular to the primary direction of travel of the dispensing control member 60, but may be positioned at other angles with respect to the primary direction of travel of the dispensing control member.

Figure 5:
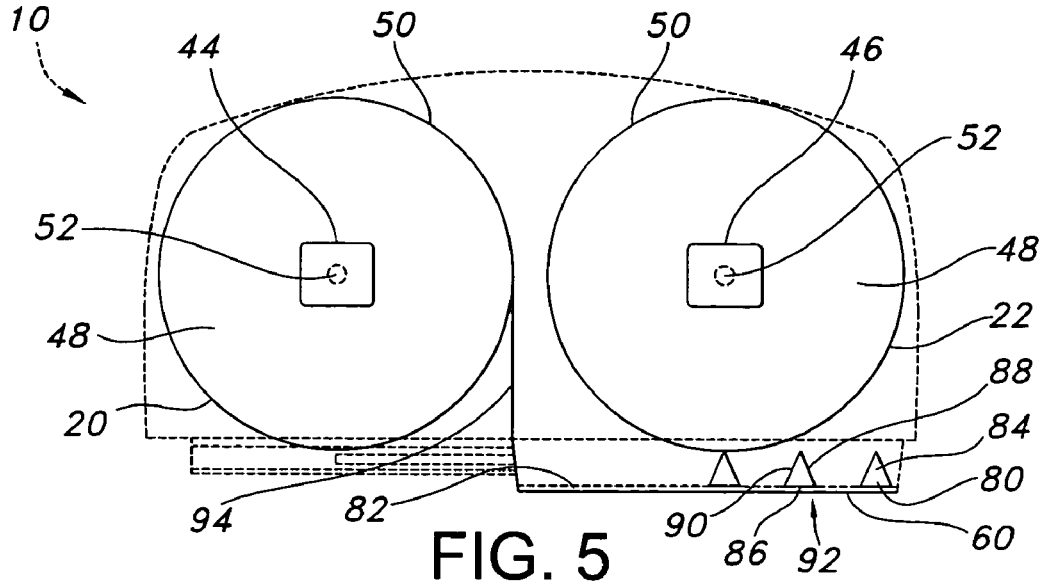
FIGS. 5–7 are schematic operational front views of an embodiment of a dispenser.
Figure 6:
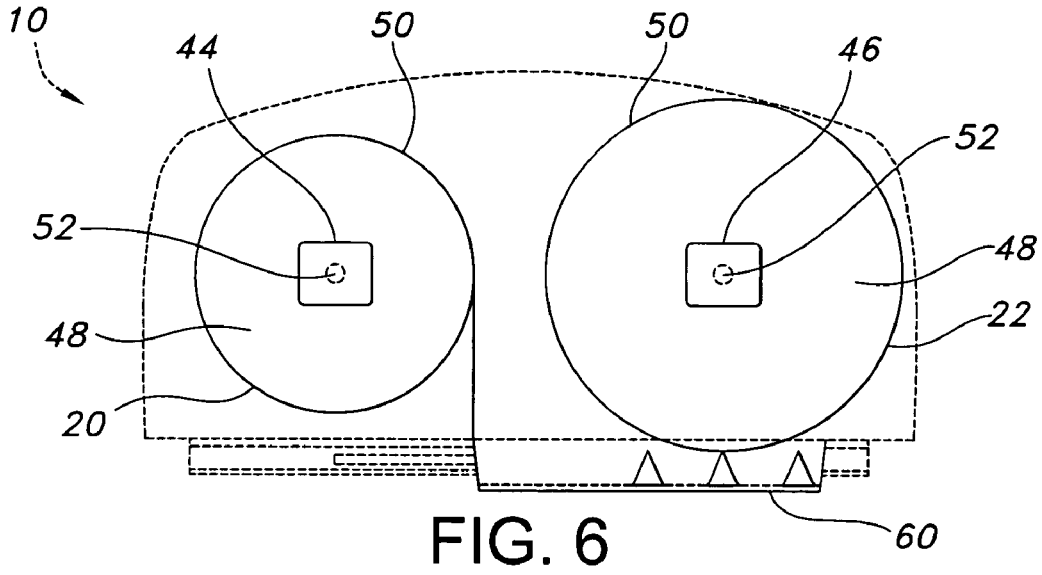
Figure 7:
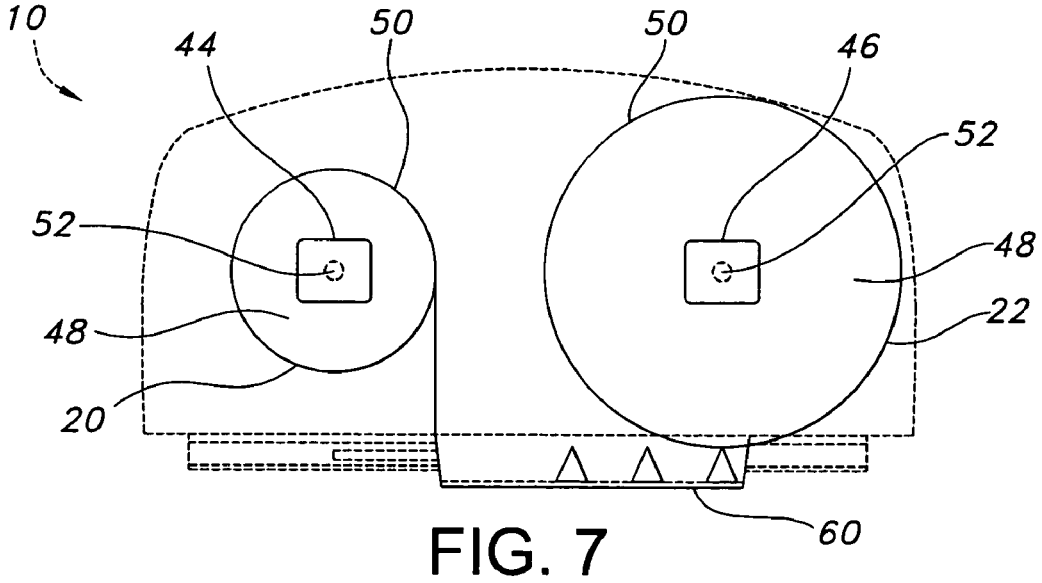

In one embodiment, the dispensing control member 60 further includes a divider 94 extending into the interior compartment 18 of the housing 12 between the primary roll of sheet material and the backup roll of sheet material. The divider 94 desirably extends to a distance sufficient to substantially restrict movement of the dispensing control member 60 in a primary direction of travel prior to substantial depletion of the primary roll of sheet material 20. Therefore, the movement of the dispensing control member 60 is restricted according to the size of the primary roll of sheet material 20 as shown in FIGS. 5–7. When the primary roll of sheet material 20 is at its largest size as shown in FIG. 5, the divider 94 allows relatively little movement of the dispensing control member 60 from its position below the backup roll of sheet material 22. As sheet material from the primary roll 20 is dispensed and the primary roll becomes smaller, the dispensing control member 60 becomes capable of moving farther from its initial position below the backup roll 22 as shown in FIGS. 6 and 7. However, the means for substantially restricting rotation of the backup roll 22 continues to substantially restrict the rotation of the backup roll until the sheet material on the primary roll 20 is substantially depleted.

In a method of use, rolls of sheet material may be loaded into the dispenser embodiments described above. The method includes disposing a primary roll of sheet material and a backup roll of sheet material within the housing and moving or sliding the dispensing control member to a position wherein rotation of the backup roll of sheet material is at least substantially restricted.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The invention claimed is:

1. A dispenser for storing and dispensing rolled sheet material, comprising:

a housing having an interior and configured to rotationally support a primary roll of sheet material and a backup roll of sheet material therein and formed to include an exit port; and a dispensing control member moveably positioned substantially within and partially blocking the exit port, the dispensing control member comprising a plurality of projections positioned on an inside surface of the dispensing control member, wherein the projections are configured to substantially restrict rotation of the backup roll of sheet material.

2. The dispenser of claim 1, wherein at least one projection comprises a triangular rib.

3. The dispenser of claim 2, wherein an edge of the triangular rib is attached to the inside surface of the dispensing control member, the attached edge being oriented parallel to a direction of travel of the dispensing control member.

4. The dispenser of claim 3, wherein the attached edge is shorter than first and second edges of the triangle extending from the inside surface of the dispensing control member.

5. The dispenser of claim 1, wherein the plurality of projections are positioned on the inside surface of the dispensing control member in rows having at least two projections, the rows positioned substantially perpendicular to a primary direction of travel of the dispensing control member.

6. The dispenser of claim 1, wherein at least one projection is in contact with the outer circumferential surface of the backup roll.

7. The dispenser of claim 1, wherein the exit port has a substantially rectangular configuration.

8. The dispenser of claim 1, wherein the dispensing control member further comprises a divider extending into the housing interior between the primary roll of sheet material and the backup roll of sheet material to a distance sufficient to substantially restrict movement of the dispensing control member in a primary direction of travel prior to substantial depletion of the primary roll of sheet material.

9. A method of loading rolls of sheet material in a dispenser adapted to hold at least two rolls of sheet material, the method comprising:

providing the dispenser of claim 1;

disposing a primary roll of sheet material and a backup roll of sheet material within the housing; and moving the dispensing control member to a position wherein rotation of the backup roll of sheet material is substantially restricted.

10. A dispenser for storing and dispensing rolled sheet material, comprising:

a housing having an interior and configured to rotationally support a primary roll of sheet material and a backup roll of sheet material therein, the housing formed to include an exit port, the exit port positioned to allow insertion of the primary roll of sheet material and the backup roll of sheet material into the housing interior; and a dispensing control member moveably positioned substantially within and partially blocking the exit port, the dispensing control member comprising:

a divider extending into the housing interior between the primary roll of sheet material and the backup roll of sheet material to a distance sufficient to substantially restrict movement of the dispensing control member prior to substantial depletion of the primary roll of sheet material; and a plurality of ribs positioned on an inside surface of the dispensing control member, the ribs positioned to substantially restrict rotation of the backup roll of sheet material prior to substantial depletion of the primary roll of sheet material.

11. The dispenser of claim 10, wherein the ribs are substantially triangular in shape.

12. The dispenser of claim 11, wherein an edge of the triangular ribs is attached to the inside surface of the dispensing control member, the attached edge being oriented parallel to a direction of travel of the dispensing control member.

13. The dispenser of claim 12, wherein the attached edge is shorter than first and second exposed edges of the triangle.

14. The dispenser of claim 10, wherein the ribs are positioned on the inside surface of the dispensing control member in rows having at least two ribs, the rows positioned substantially perpendicular to a direction of travel of the dispensing control member.

15. The dispenser of claim 10, wherein at least one of the ribs is in contact with the outer circumferential surface of the backup roll.

16. The dispenser of claim 10, wherein the exit port has a substantially rectangular configuration.

17. A method of loading rolls of sheet material in a dispenser adapted to hold at least two rolls of sheet material, the method comprising:

providing the dispenser of claim 10;

disposing a primary roll of sheet material and a backup roll of sheet material within the housing; and sliding the dispensing control member to a position wherein rotation of the backup roll of sheet material is substantially restricted by at least one rib.

* * * * *